US008132577B2

(12) United States Patent
Recchion et al.

(10) Patent No.: US 8,132,577 B2
(45) Date of Patent: Mar. 13, 2012

(54) ADJUSTABLE AUTO-CLASP BARRETTE

(75) Inventors: Justin Recchion, Atlanta, GA (US); Joni Lay, Smyrna, GA (US)

(73) Assignee: Goody Products, Inc., Atlanta, GA (US)

( * ) Notice: Subject to any disclaimer, the term of this patent is extended or adjusted under 35 U.S.C. 154(b) by 202 days.

(21) Appl. No.: 12/503,514

(22) Filed: Jul. 15, 2009

(65) Prior Publication Data

US 2010/0012144 A1 Jan. 21, 2010

Related U.S. Application Data

(60) Provisional application No. 61/080,834, filed on Jul. 15, 2008.

(51) Int. Cl.
*A45D 8/28* (2006.01)

(52) U.S. Cl. ..... 132/279; 24/518

(58) Field of Classification Search ..... 132/131, 132/136, 155, 148, 254, 273, 275–279; 24/455, 24/49.1, 490–492, 505, 517, 511, 518; 63/20, 63/43; D28/39, 42
See application file for complete search history.

(56) References Cited

U.S. PATENT DOCUMENTS 3,609,823 A * 10/1971 Boots ..... 24/66.2
5,181,300 A * 1/1993 Schwarz ..... 24/578.1
5,365,955 A * 11/1994 Desgroux et al. ..... 132/279
6,023,318 A * 2/2000 Tomono et al. ..... 349/146
6,023,818 A * 2/2000 Shang ..... 24/501
6,311,700 B1 * 11/2001 Yeh ..... 132/279
6,378,532 B1 4/2002 Chou et al.
7,181,806 B2 * 2/2007 Folkmar ..... 24/30.5 R
2006/0144416 A1 * 7/2006 Neal ..... 132/275
2007/0163616 A1 7/2007 Chou

FOREIGN PATENT DOCUMENTS

CN 2872935 Y * 2/2007

OTHER PUBLICATIONS

International Search Report for PCT application PCT/US2009/050701; dated Sep. 9, 2009, 9 pages.

* cited by examiner

*Primary Examiner* — Todd Manahan
*Assistant Examiner* — Jennifer Gill
(74) *Attorney, Agent, or Firm* — Lempia Summerfield Katz LLC

(57) ABSTRACT

An adjustable auto-clasp barrette includes a base, a hinged and clasped locking arm, and a resilient leaf spring positioned between the base and the locking arm. The locking arm and the leaf spring cooperate to engage the hair to secure the barrette in the user's hair. An adjustment coupling permits the positions of the leaf spring ends to be longitudinally adjusted relative to the base to increase or decrease how much the leaf spring deflects and bows outwardly. With the spring ends positioned farther apart the leaf spring is less bowed for holding thicker hair or a larger volume of finer hair. And with the spring ends positioned closer together the leaf spring is more bowed for holding finer hair or a smaller volume of thick hair.

19 Claims, 7 Drawing Sheets

ADJUSTABLE AUTO-CLASP BARRETTE

CROSS-REFERENCE TO RELATED APPLICATION

This application claims the priority benefit of U.S. Provisional Patent Application Ser. No. 61/080,834, filed Jul. 15, 2008, which is hereby incorporated herein by reference.

TECHNICAL FIELD

The present invention relates generally to hairstyling accessories and, in particular, to barrettes and similar hair clips for holding hair in place.

BACKGROUND

Typical commercially available auto-clasp barrettes are designed in only one size to hold the same volume of hair. Thus, a user with thick/coarse hair would use the same size auto-clasp barrette as a user with thin/fine hair. Also, the same size auto-clasp barrette would be used to secure all a user's hair or only a portion of it. Accordingly, these auto-clasp barrettes are not ideal for every situation. For example, such auto-clasp barrettes can easily slide out of thin hair or can break when trying to be forced to secure a lot of thick hair.

Accordingly, it can be seen that needs exist for improved auto-clasp barrettes that can be used on thick or fine hair to hold all or only a portion of the user's hair. It is to the provision of solutions to these and other problems that the present invention is primarily directed.

SUMMARY

Generally described, the present invention relates to hair clips such as auto-clasp barrettes that can be adjusted to provide more or less compressive holding force on the hair. This enables the user to customize the same barrette to provide less compressive force for holding most any volume of thick hair or a large volume of thin hair, or to provide more compressive force for holding most any volume of thin hair or a small volume of thick hair.

The barrette includes a base, a locking arm, a leaf spring, and at least one adjustment coupling. Each adjustment coupling includes one or more guide tracks longitudinally positioned on the base and one or more sliders extending from the leaf spring (e.g., at one or both of the leaf spring ends). The sliders slide longitudinally along the guide tracks to permit the leaf spring to be bowed/tensioned and un-bowed/un-tensioned so that it exerts a user-selected compressive force on the hair and locking arm. Each adjustment coupling also includes a releasable lock assembly for securing the sliders in the user-selected position during the normal use of the barrette.

In a first example embodiment, two guide track channels are formed all the way through the base and two sliders are defined by the free ends of the leaf spring, with the spring ends/sliders extending through the channels. The spring ends/sliders include caps at the outer surface of the base that can be moved to slide the spring ends/sliders along the guide channel. The channel includes locking stations for example defined by notches that receive the spring ends/sliders to releasably secure them in place. Accordingly, the cap can be moved longitudinally to re-position the spring ends/sliders to produce more bowing in the leaf spring for holding fine hair or only a small portion of thin hair or to produce less bowing for holding coarse thick hair or a large portion of thin hair.

In a second example embodiment, the sliders each include a body with an adjustment spring extending laterally from it and the channels each include a serrated wall with teeth and notches. The slider spring engages the notches, which define locking stations, to releasably secure the sliders (and thus the leaf spring ends) in place. When a sufficient longitudinal force is applied to the sliders, the adjustment springs contact the teeth and resiliently retract laterally to permit the sliders to travel along the channel to adjust the bowing in the leaf spring.

In a third example embodiment, the sliders each include a body with an adjustment spring extending upwardly from it and the channels each include a serrated wall with teeth and notches. The slider spring engages the notches, which define locking stations, to releasably secure the sliders (and thus the leaf spring ends) in place. When a sufficient longitudinal force is applied to the sliders, the adjustment springs contact the teeth and resiliently retract downwardly to permit the sliders to travel along the channel to adjust the bowing in the leaf spring.

The specific techniques and structures employed by the invention to improve over the drawbacks of the prior devices and accomplish the advantages described herein will become apparent from the following detailed description of the example embodiments of the invention and the appended drawings and claims.

DESCRIPTION OF EXAMPLE EMBODIMENTS

Generally described, the present invention relates to an auto-clasp barrette that can be adjusted by the user depending on how much hair (e.g., all/almost all of her hair or only a portion of her hair) and the type of hair (e.g., fine or coarse) to be secured. Thus, the user is able to adjust the amount of compression the barrette exerts on her hair. Generally, a user securing all of her coarse hair would not need as much compression by the barrette as a user securing a portion of her fine hair. Accordingly, a single barrette size can be used for a variety of hairstyles because the user can increase the compression of the barrette for a half-up style and decrease the compression for a full updo. As used herein, the term "auto-clasp barrette" includes similar hair clips such as contour clips, claw clips, non-auto-clasp barrettes, etc.

Figure 1:
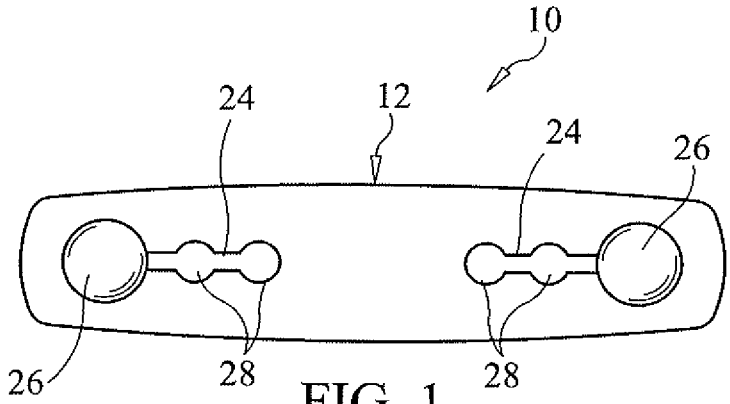
FIG. 1 is a top view of a barrette according to a first example embodiment of the present invention, showing guide channels and leaf-spring caps that slide along the channels for leaf-spring adjustment.
Figure 2:
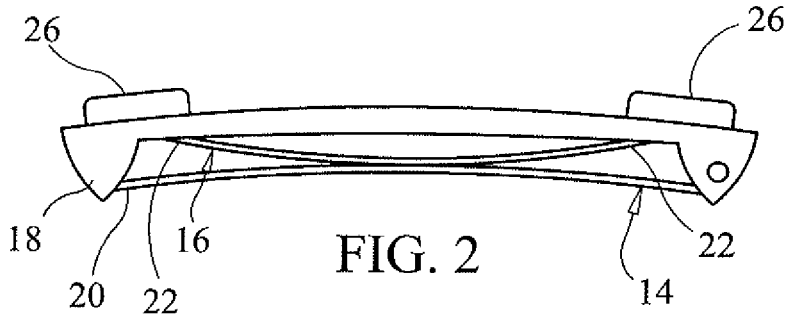
FIG. 2 is a side view of the barrette of FIG. 1, showing a locking arm in a closed position compressed against the leaf spring.

FIGS. 1 and 2 show an adjustable auto-clasp barrette 10 according to a first example embodiment of the present invention. The barrette 10 includes a base 12, a locking arm (i.e., a hair-retaining arm) 14 hingedly connected to the base, and a leaf spring 16 positioned between the base and the locking arm. The base 12 includes a clasp 18 that engages a cooperating free-end portion 20 of the locking arm 14 to secure the locking arm in the closed (or locked or "in use") position. The leaf spring 16 cooperates with the locking member 14 to securely hold the user's hair between them when the barrette 10 is in the closed position, thereby securing the barrette in the user's hair. The leaf spring 16 can be provided by a generally bowed strip of a resilient material such as a plastic or metal, with its ends coupled to the base 12 or the locking arm 14.

In addition, the barrette 10 also includes at least one adjustment coupling that can be manipulated to adjust the coupling position along a longitudinal axis of the base 12 to adjust the tension of the leaf spring 16 and thus the compressive force it exerts on the hair. For example, the adjustable coupling can include at least one guide track longitudinally formed in the base or the locking arm, and at least one free end of the leaf spring 16 that slides along the track. In the depicted embodiment, the leaf spring 16 has two free ends 22, each extending through a guide track channel 24 formed all the way through the base 12, each extending beyond the outer surface of the base, and each defining a slider element. The spring free ends/sliders 22 can each include at least one cap (e.g., a button or knob) 26 that is positioned at the outer surface (away from the hair) of the base 12 and that can be easily manipulated by a user to slide that spring free end along its channel 24. The channels 24 each have one or more (e.g., the two depicted) serrated walls that each define one or more teeth and one or more notches, with the notches defining one or more locking stations 28 (e.g., the two depicted) in which the respective spring free end 22 can be releasably secured. For example, the geometry and dimensions of the locking stations 28 and a cross-section of the spring free ends/sliders 22 can be selected so that the spring free ends fit snugly within the locking stations, with the spring free ends made of a resilient material that is deformable to permit them to slide along the channel 24 between the locking stations, thereby forming a detent mechanism.

In an alternative embodiment, the spring free ends/sliders each include a collar that fits snugly within the locking stations and a recessed portion that that can easily slide along the respective channel between the locking stations, with the collar and the recess being selectively aligned with the base upon the application of a pushing or pulling force on the respective cap. In other alternative embodiments, the spring free ends/sliders include one or more laterally extending springs (deflectable fins, fingers, or other protrusions) that are received in the locking stations.

In any case, the compression that the leaf spring 16 (in cooperation with the locking arm 14) will apply to the hair can be easily adjusted. The user can slide one or both the spring caps 26 toward the longitudinal middle of the base 12 to increase the compression and slide one or both of them toward the ends of the base to decrease the compression. This is because moving the free ends/sliders 22 of the leaf spring 16 toward each other causes the spring to deflect and bow outward more so that the locking arm 14 contacts it sooner when moved to the closed position. And moving the spring free ends 22 away from each other causes the leaf spring 16 to deflect back to a less bowed-out configuration so that the locking arm 14 contacts it later (or not at all) when moved to the closed position. The spring free ends/sliders 22 lock into the locking stations 28 at the user-selected positions of the spring free ends to retain the leaf spring 16 in the adjusted position.

Figure 3:
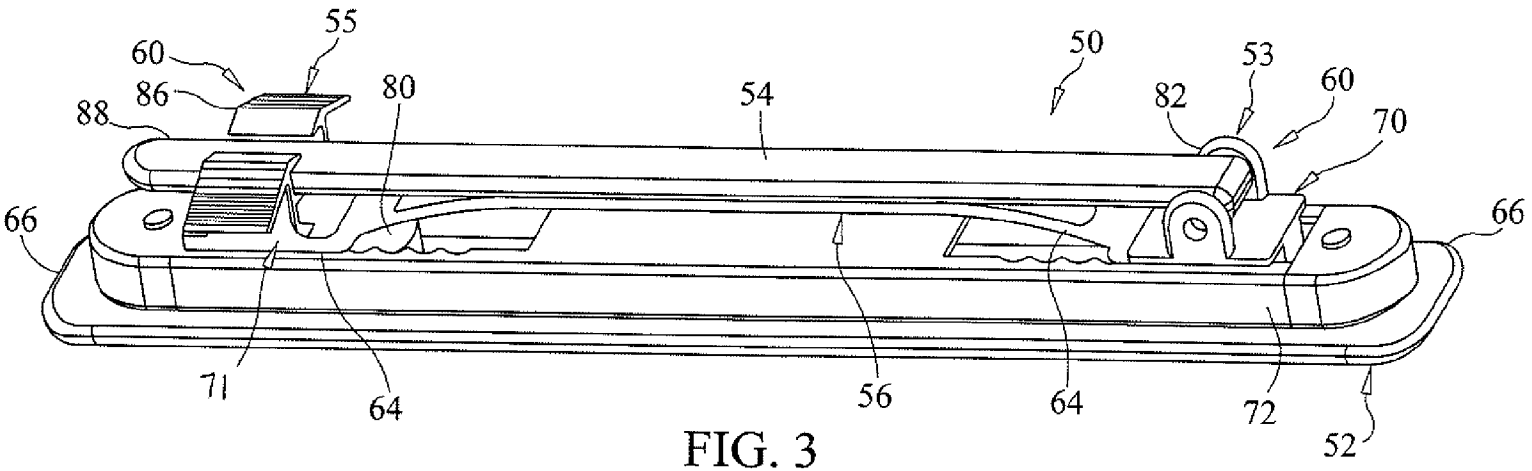
FIG. 3 is a perspective view of a barrette according to a second example embodiment of the present invention, showing guide channels and sliders that slide along the channels for leaf-spring adjustment.
Figure 4:
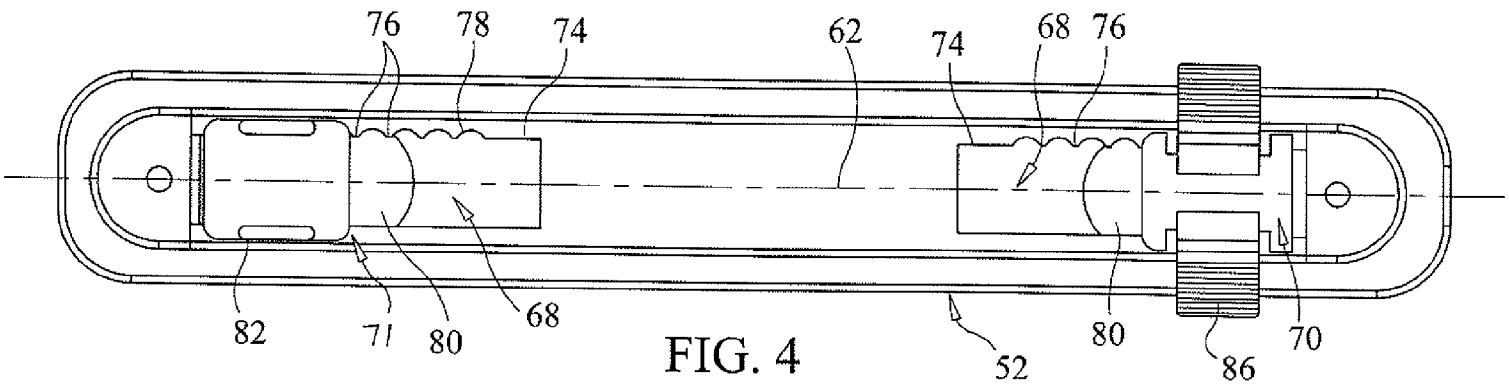
FIG. 4 is a top view of the base of the barrette of FIG. 3.

FIGS. 3-8 depict an adjustable auto-clasp barrette 50 according to a second example embodiment of the present invention. With reference to FIGS. 3 and 4, the barrette 50 includes a base 52, a locking arm (i.e., a hair-retaining arm) 54, and a leaf spring 56 positioned between the base and the locking arm. The locking arm 54 pivots relative to the base 52 about a hinge 53 and is secured in a closed position by a clasp 55. The leaf spring 56 cooperates with the locking member 54 to securely hold the user's hair between them when the barrette 50 is in the closed position, thereby securing the barrette in the user's hair.

The locking arm 54 and the leaf spring 56 are adjustably connected to the base 52 by at least one adjustment coupling 60 that can be manipulated to adjust the coupling position along a longitudinal axis 62 of the base to adjust the tension of the spring. In the depicted embodiment, two slide couplings 60 are longitudinally spaced apart and slidably connect the leaf spring 56 near its ends 64 to the base 52 near its ends 66. The slide couplings 60 include at least one guide track longitudinally formed in or on the base 52 and at least one slider that extends from the leaf spring 56 and slides along the guide track. For example, two aligned guide track channels 68 can be longitudinally formed in the base 52 (e.g., in a rail 72 that protrudes from the base), and two sliders, including a hinge-end slider 70 and a clasp end slider 71, can be provided with one at each spring end 64 and with a portion of each slider received in one of the channels, as depicted. Thus, the leaf spring 56 extends between and is secured to (or integrally formed as a part of) the hinge-end slider 70 and the clasp-end slider 71. In addition, the guide track channels 68 each define one or more locking stations in which the respective hinge-end slider 70 and/or the clasp-end slider 71 can be releasably secured, as described below.

Figure 5:
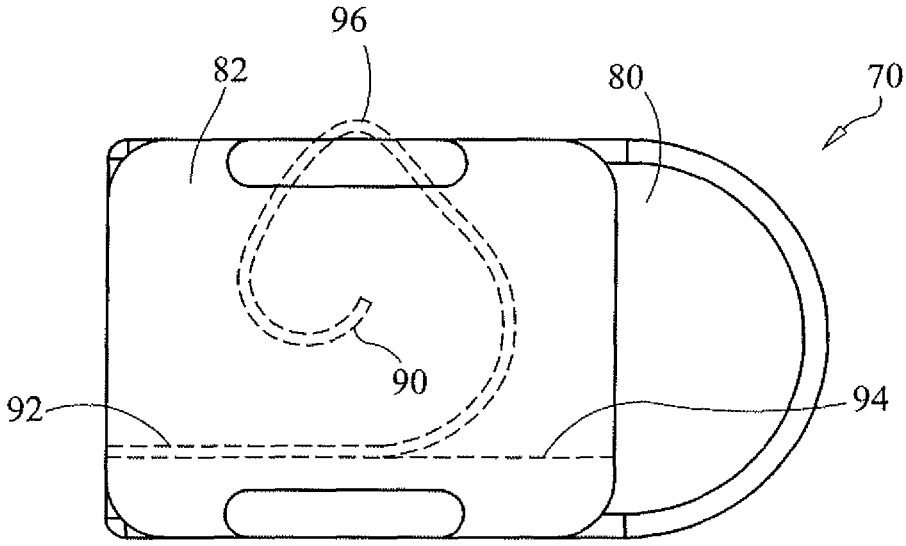
FIG. 5 is a top view of the hinge-end slider of the barrette of FIG. 3.
Figure 6:
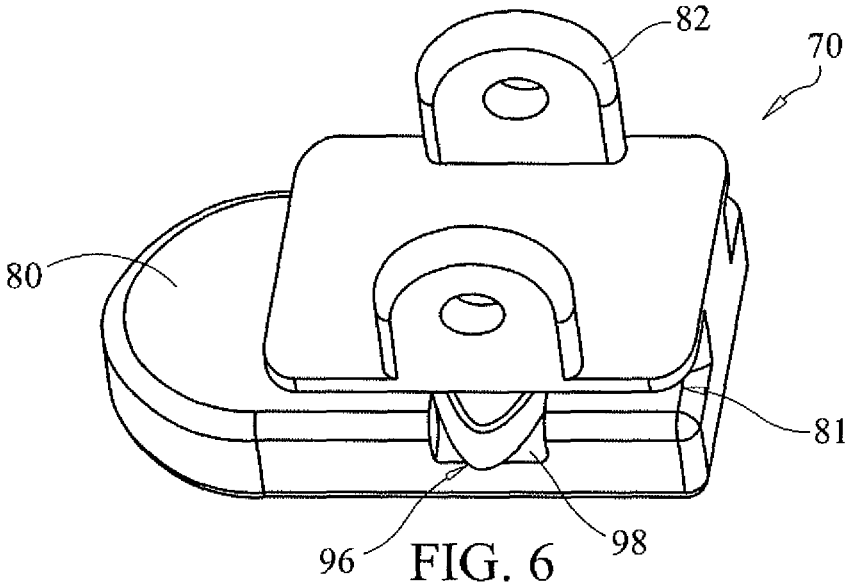
FIG. 6 is a perspective view of the hinge-end slider of FIG. 5.
Figure 7:
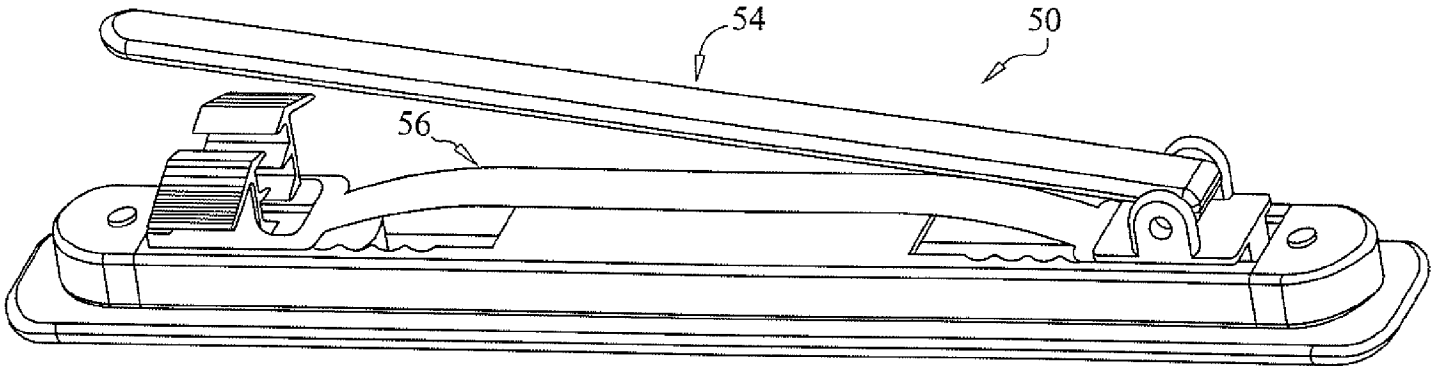
FIG. 7 is a perspective view of the barrette of FIG. 3 shown in a partially open position with the hinge-end slider and the clasp-end slider positioned farther apart so that the leaf spring is in a less-bowed configuration to provide less compression by the leaf spring against the locking arm.
Figure 8:
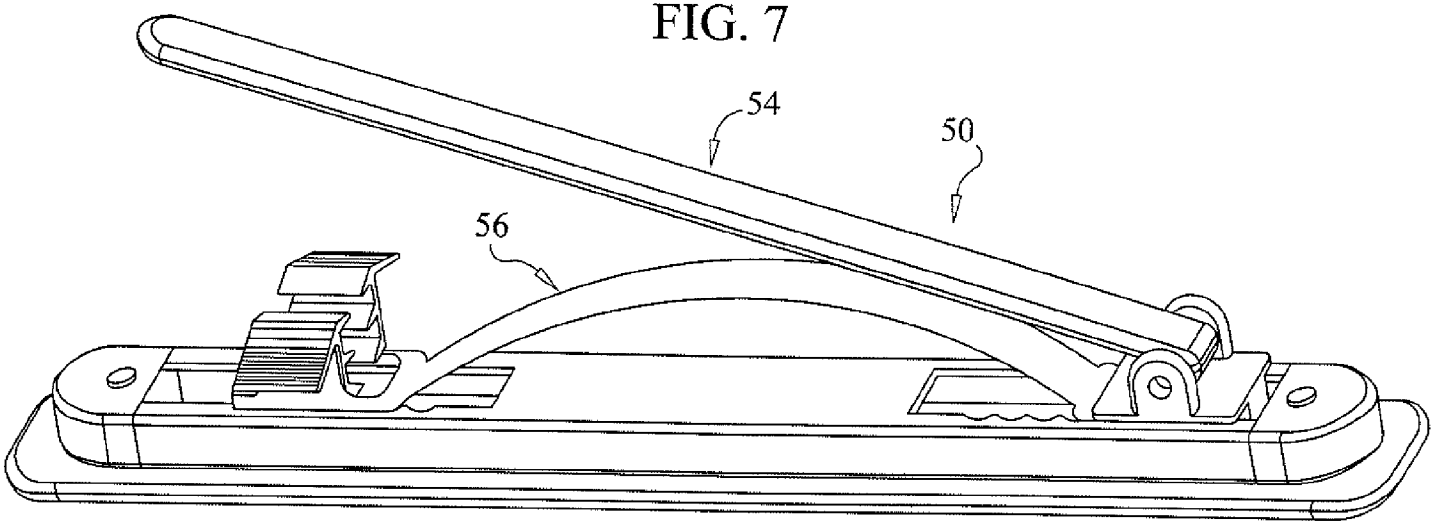
FIG. 8 shows the barrette of FIG. 7 with the clasp-end slider re-positioned to closer to the hinge-end slider so that the leaf spring is in a more-bowed configuration to provide more compression by the leaf spring against the locking arm.
Figure 9:
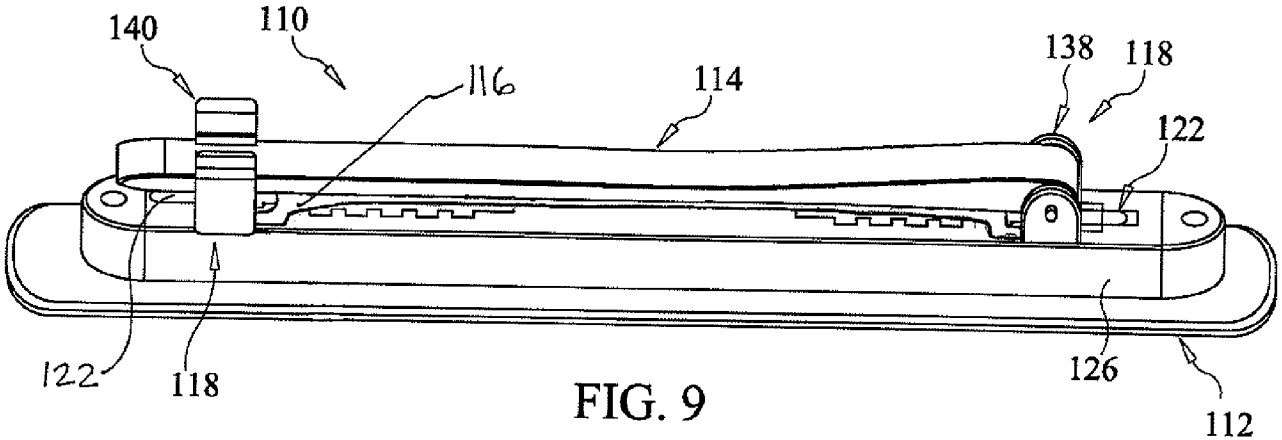
FIG. 9 is a perspective view of a barrette according to a third example embodiment of the present invention, showing guide channels and sliders that slide along the channels for leaf-spring adjustment.
Figure 10:
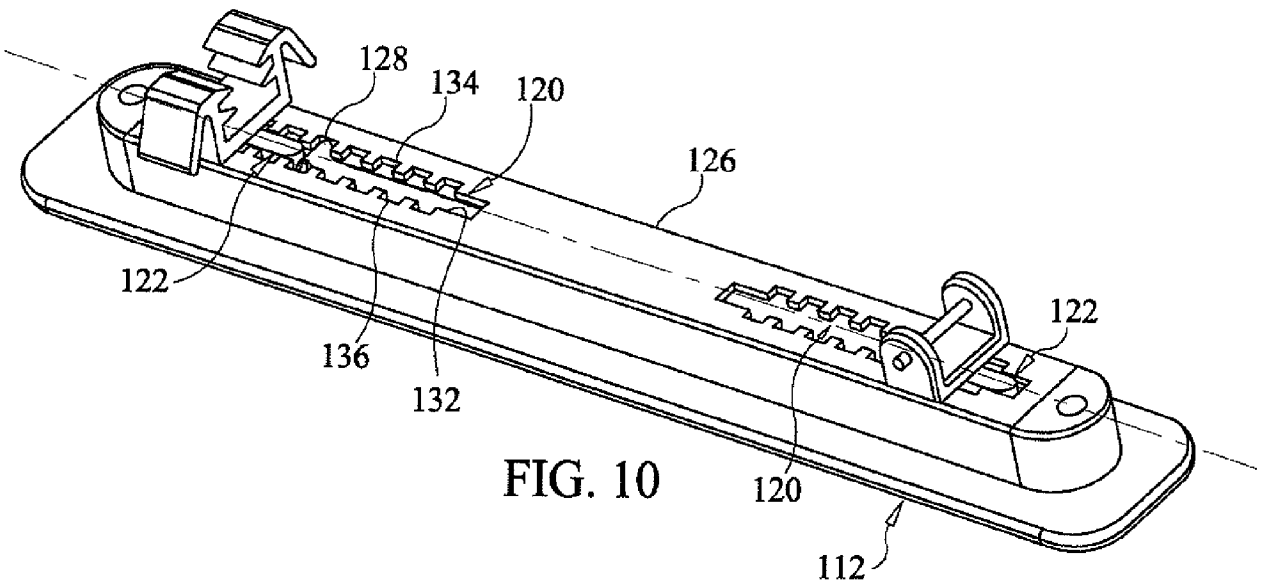
FIG. 10 is a perspective view of the base of the barrette of FIG. 9.

Referring additionally to FIGS. 5 and 6, a portion of the hinge 53, which permits the locking arm 54 to pivot between its open and closed positions, is attached to or integrally formed as a part of the hinge-end slider 70. In the depicted embodiment, the hinge-end slider 70 includes a body 80 with a hinge bracket 82 that extends from its top surface and that cooperates with a hinge pin (not shown) of a hinged end of the locking arm 54. Thus, the locking arm 54 slides along with the hinge-end slider 70. Each of the sliders 70, 71 includes at least one groove (e.g., the two depicted grooves defined between the body 80 and the hinge bracket 82) that receives at least one inwardly extending lip of the respective channel 68 to retain the slider on the base 52. Similarly, a portion of the clasp 55, which releasably secures the locking arm 54 in its closed position, is attached to or integrally formed as a part of the clasp-end slider 71. The clasp-end slider 71 is similar to the hinge-end slider 70 in that it includes a body 80, but it has a clasp portion 86 that extends from its top surface and engages a free end 88 of the locking arm 54 when the barrette 50 is in its closed position (instead of the hinge bracket of the hinge-end slider). Also, the locking arm 54 extends through the clasp 55, so the locking arm does not slide along with the clasp-end slider 71.

The sliders 70, 71 each have an adjustment spring 90 deflectably extending from them. The adjustment springs 90 can be provided by compression springs (e.g., the depicted belt-shaped spring), tension springs, elastic members, or other spring elements known in the art. In the depicted embodiment, the bodies 80 of the sliders 70, 71 each have an internal cavity that houses the adjustment spring 90. A fixed portion 92 of each spring 86 is mounted to the slider body 80 (e.g., at an inner wall 94) and an engagement portion 96 of each spring extends through a window 98 in the slider body (e.g., in an opposing sidewall) when the spring is in its extended position. In addition, a longitudinal wall 74 of each guide track channel 68 is generally serrated with a series of teeth 76 and notches 78 formed along it. The teeth 76 can be flat-tipped (as depicted), generally pointy, ramped (curved or angled), etc. and the notches 78 can be curved (as depicted), rectangular, flat-bottomed, ramped (curved or angled), etc. The spring engagement portion 96 deflects to a retracted position upon engagement with the teeth 76 of the channel wall 74, and resiliently returns to its extended position when not in engagement with the teeth. The spring engagement portion 96 is not engaged by the teeth 76 when it is aligned with and received in the notches 78 between the teeth. As such, the locking stations are defined by the notches 78, which receive the spring engagement portion 96 to hold the sliders 70, 71 in user-selected positions.

In operation, a user can adjust the compression of the leaf spring 56 by applying enough longitudinal force to the sliders 70, 71 to overcome the lateral biasing forces of the spring engagement portions 96 against the serrated channel walls 74. When this is done, the sliders 64 can slide within the channel 70 in either direction along the longitudinal axis 62. For example, if the user wants to decrease the compression on the hair (such as when securing a large amount of finer hair or securing thicker hair), the user moves one or both of the sliders 70, 71 toward the ends of the base 52 (i.e., away from each other), thereby causing the leaf spring 56 to bow less and provide less compression against the locking arm 54 (e.g., see FIG. 7). Similarly, if the user wants to increase the spring compression on the hair (such as when securing a small amount of thicker hair or securing finer hair), the user moves a selected one or both of the sliders 70, 71 towards the longitudinal center of the base 52 (i.e., toward each other), thereby causing the leaf spring 56 to bow more and provide more compression against the locking arm 54 (e.g., see FIG. 8). In this way, the user can customize the barrette 50 so that it works best for her particular hair type and for a variety of different hairstyles.

Once the user has adjusted the barrette 50 to provide the desired spring compression, the user releases the force exerted on the sliders 70, 71. The engagement portion 96 of the adjustment spring 90 will seat into one of the notches 78 between two of the teeth 76 of the serrated channel wall 74, thereby holding the slider or sliders 70, 71 in place during normal use of the barrette 50. In other words, each slide coupling 60 functions in a manner somewhat similar to a ratchet and pawl, with the generally serrated wall 74 being a linear rack and the spring engagement portion 96 being the pawl. Accordingly, the slide couplings 60 allow the user to adjust the compression of the barrette 50 by adjusting the tension and bowing of the leaf springs 56.

The base 52, the locking arm 54, the leaf spring 56, and the slide coupling 60 can be injection molded of a thermoplastic elastomer (TPE) such as nylon or acrylonitrile butadiene styrene (ABS), with these components (and any sub-components) snap-fit or welded together. These components can be made with smooth edges to reduce or eliminate snagging in the hair and to permit the barrette 50 to glide smoothly in and out of the hair. In addition, the hair-engaging surfaces of the locking arm 54 and the leaf spring 56 can be made of or coated with a material having a high coefficient-of-friction to better secure the barrette 50 in the hair. Furthermore, the outer surface of the base 52 can be integrated with or form part of an aesthetically pleasing design. For example, the base 52 can include jewels, embellishments, over-molded decorative elements, or the like.

In alternative embodiments, the barrette includes a single guide channel positioned adjacent one end of the base and along which slide two sliders at the spring ends, or a single guide channel adjacent one end of the base in which slides a single slider at the corresponding end of the spring. In another alternative embodiment, both opposing walls of the channels are serrated and are engaged by springs extending from both sides of the slider body. In yet another alternative embodiment, one or both of the channel sidewalls have one or more springs (e.g., resiliently deflectable fins, fingers, cantilevers, or other protrusions) extending from them and one or both sides of the slider body are serrated and engaged by channel springs. In still another alternative embodiment, the adjustment spring is provided by a portion of the slider body itself that is made of a resilient material so that it deforms upon engagement with the teeth to permit the slider to travel in the channel and that relaxes into the notches to hold the slider in position with a snap fit to form a detent mechanism. And in yet still another alternative embodiment, the guide tracks are provided by rails that protrude from the base (instead of channels recessed into the base) and the sliders each have one or two sidewalls that extend from them and form a channel that slidingly receives the guide rail. In this alternative embodiment, one or both of the slider sidewalls slidingly engage one or both sidewalls of the guide rails, and one or more springs (e.g., resiliently deflectable fins, fingers, cantilevers, pushbuttons, or other protrusions) extend from the guide-rail sidewalls and through one or more openings in the slider sidewalls.

FIGS. 9-13 depict an adjustable auto-clasp barrette 110 according to a third example embodiment of the present invention. The barrette 110 of this embodiment is similar to that of the second example embodiment in that it includes a base 112, a locking arm 114, a leaf spring 116, and at least one adjustment coupling 118. Each adjustment coupling 118 includes at least one guide track 120 longitudinally arranged on the base 112 and at least one slider 122 at one of the leaf spring ends. The sliders 122 slide longitudinally along the guide tracks 120 to permit the leaf spring 116 to be bowed/tensioned and un-bowed/un-tensioned so that it exerts a user-selected compressive force on the hair and locking arm 114.

In the depicted embodiment, the guide tracks 120 are formed by guide channels in the base 112 (e.g., in the top surface of a rail 126 protruding from the base, as depicted) that slidingly receive the engagement portion 128 of the adjustment spring 130. The guide channels 120 each include a serrated wall 132 defining teeth 134 and notches 136, with the notches defining locking stations that secure the sliders 122 in pace. The teeth 134 and the notches 136 can be rectangular (as depicted), ramped (curved or angled), flat-tipped and/or -bottomed, etc. One of the sliders 122 has a hinge bracket 138 mounted to it and the other slider has a clasp 140 mounted to it.

Figure 11:
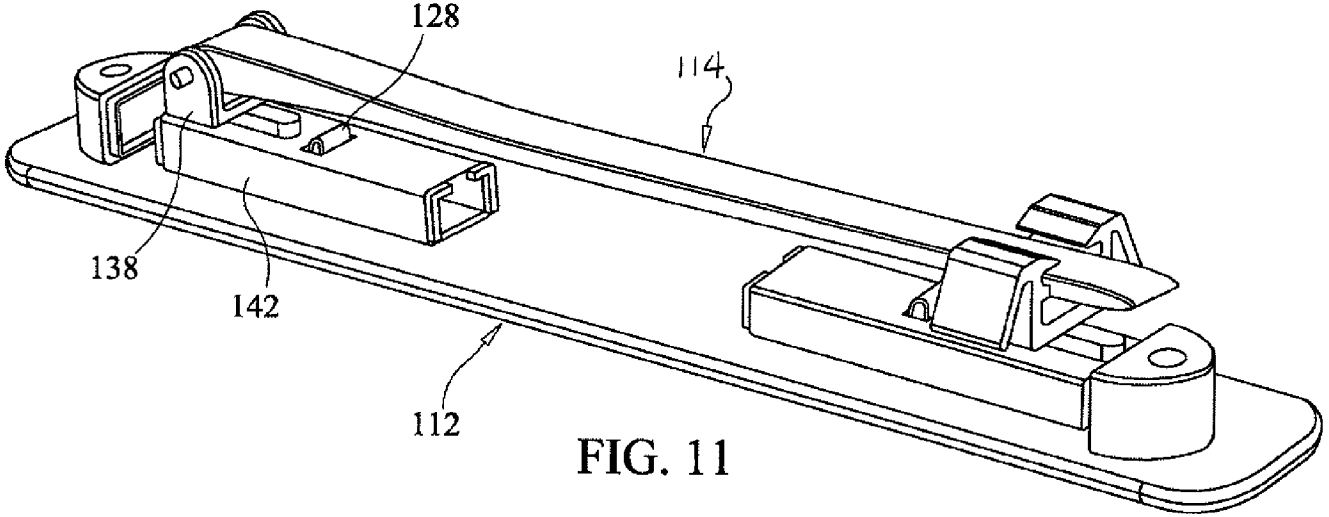
FIG. 11 is a perspective view of the base and the locking arm of the barrette of FIG. 9.
Figure 12:
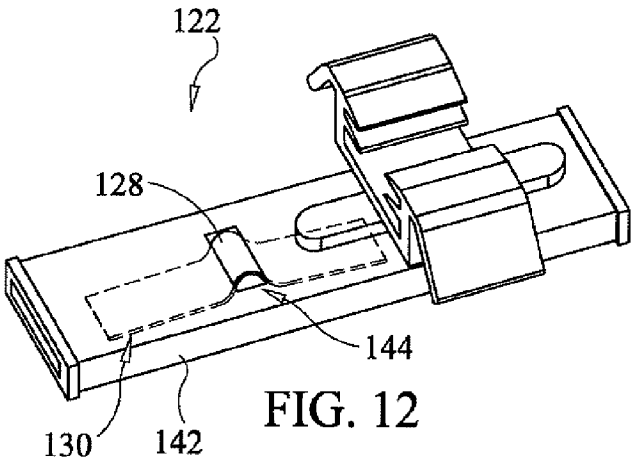
FIG. 12 is a perspective view of the clasp-end slider of FIG. 9.
Figure 13:
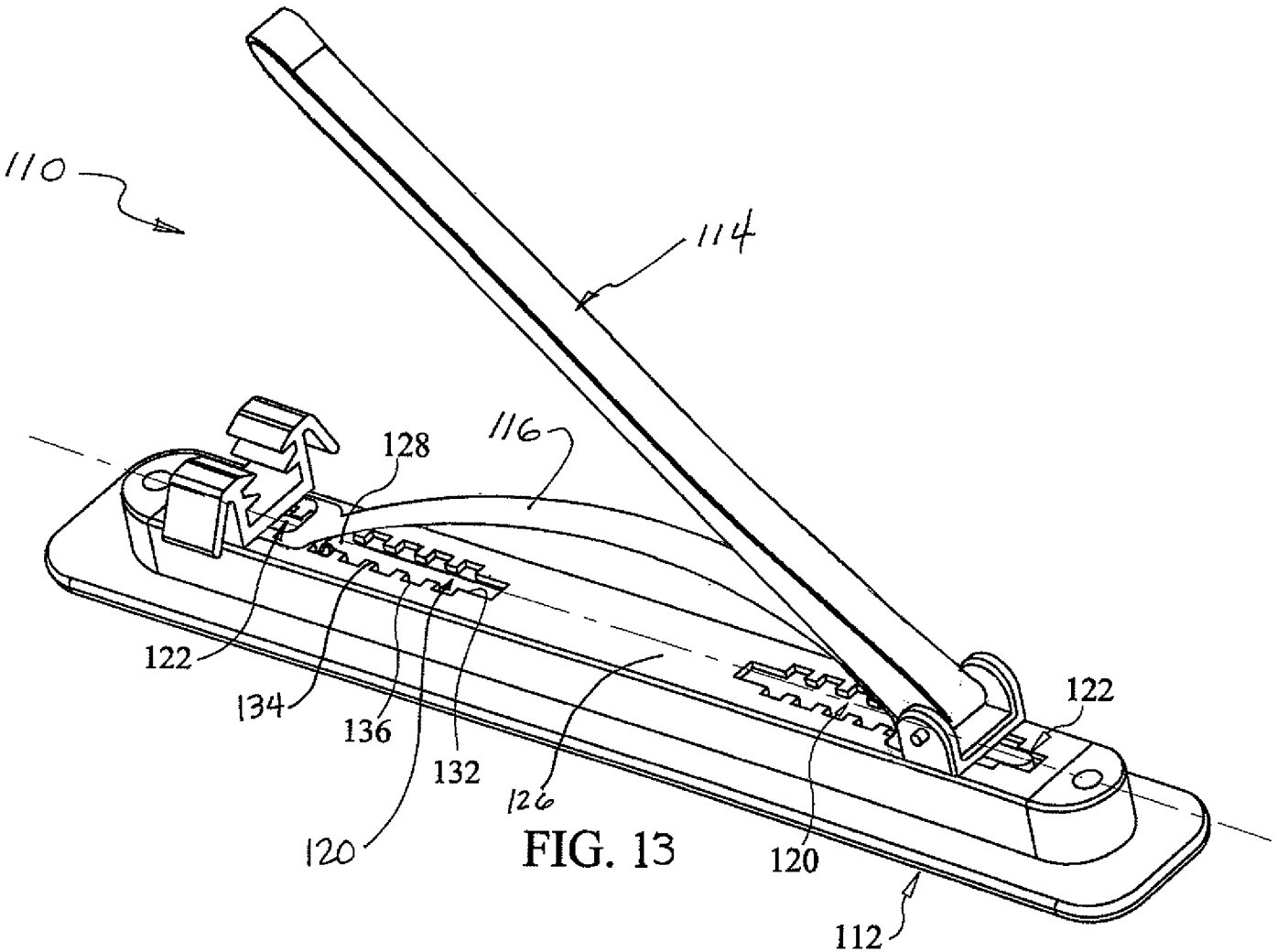
FIG. 13 is a perspective view of the barrette of FIG. 9 with a leaf spring and the locking arm in an open configuration.

In the barrette 110 of this embodiment as shown in FIGS. 11 and 12, however, the adjustment springs 130 extend upright toward the hair (instead of laterally) from the slider bodies 142, with the spring engagement portions 128 extending upright toward the hair (instead of laterally) through windows 144 in the top surfaces of the slider bodies 142 and into the guide channels 124. In FIG. 11 the leaf spring 116 and the rail 126 are removed from the barrette 110 to better illustrate the slider bodies 142 and the upright spring engagement portions 128. When the upright spring engagement portions 128 are positioned in the notches 136, the teeth 134 secure the sliders 122 in place. FIG. 13 shows the barrette 110 including the rail 126 with the locking arm 114 in an open configuration and the leaf spring 116 in a partially bowed state and extending between the sliders 122.

In operation, the sliders 122 can be re-positioned by applying longitudinal forces to them sufficient to overcome the upward biasing forces of the spring engagement portions 128 against the channel-wall teeth 134. When this is done, the sliders 122 can slide along the channel 124 in either longitudinal direction, thereby causing the leaf spring 116 to bow more or less as may be desired to provide more or less compression to the hair. As such, the barrette 110 of this embodiment operates the same as that of the second example embodiment described above.

The elements and features of the alternative embodiments described above with respect to the second alternative embodiments can be incorporated into the barrette of this embodiment. For example, the rail can be provided with two opposing serrated channel walls, as depicted, or only one. In addition, although the present invention is described in terms of example barrettes having two slider couplings, each independently adjusting the compression of the leaf spring against the locking arm, in alternative embodiments the present invention includes barrettes with only one slider coupling and guide channel. In still another embodiment, the hinge bracket for the locking arm can be connected to the base (not to the sliders of the slider couplings) and/or the clasp for the locking arm can be connected to the base (not to the sliders of the slider couplings). Also, although the present invention is described in terms of an auto-clasp barrette, slider couplings operable to adjust the spring compression/bowing can be employed in other hair accessories, such as other barrettes, claws clips, and other types of hair clips.

It is to be understood that this invention is not limited to the specific devices, methods, conditions, or parameters of the example embodiments described and/or shown herein, and that the terminology used herein is for the purpose of describing particular embodiments by way of example only. Thus, the terminology is intended to be broadly construed and is not intended to be unnecessarily limiting of the claimed invention. For example, as used in the specification including the appended claims, the singular forms "a," "an," and "the" include the plural, the term "or" means "and/or," and reference to a particular numerical value includes at least that particular value, unless the context clearly dictates otherwise. In addition, any methods described herein are not intended to be limited to the sequence of steps described but can be carried out in other sequences, unless expressly stated otherwise herein.

While the claimed invention has been shown and described in example forms, it will be apparent to those skilled in the art that many modifications, additions, and deletions can be made therein without departing from the spirit and scope of the invention as defined by the following claims.

What is claimed is:

1. A clip for securing hair, comprising:

a longitudinal base;

a locking arm that pivots relative to the base between an open position and a closed position;

a leaf spring that is positioned between the base and the locking arm, wherein the locking arm and the leaf spring cooperatively engage the hair to secure the clip in the hair; and an adjustment coupling including at least one guide track formed by the base and at least one slider extending from the leaf spring, wherein the slider is longitudinally slidable along the track to deflect the leaf spring between a more-bowed configuration and a less-bowed configuration, in the more-bowed configuration the leaf spring exerting more compression against the locking arm and hair than it does in the less-bowed configuration, wherein the guide track is provided by a channel that is formed in the base and that receives at least a portion of the slider, wherein the channel defines at least one serrated wall including at least one tooth and at least one notch, wherein the notch defines a locking station that receives at least a portion of the slider to releasably secure the slider in place, and wherein the slider includes an adjustment spring extending therefrom with an engagement portion that seats in the notch and engages the tooth to releasably secure the slider in place.

2. The hair clip of claim 1, wherein the spring engagement portion extends laterally from the slider.

3. The hair clip of claim 1, wherein the spring engagement portion extends upwardly from the slider.

4. The hair clip of claim 3, wherein the base includes a rail protruding therefrom, the channel is formed in a top surface of the rail, and the spring engagement portion extends upwardly from the slider and into the channel.

5. The hair clip of claim 1, wherein the slider includes a body that houses the adjustment spring and a window formed therein, and wherein the spring engagement portion resiliently deflects between an extended position extending through the window and into engagement with the serrated wall and a retracted position within the body.

6. The hair clip of claim 1, wherein the leaf spring has at least one end and the slider extends therefrom.

7. The hair clip of claim 1, wherein the slider is a hinge-end slider and further includes a hinge bracket extending therefrom and the locking arm includes a hinged end connected to the hinge bracket, wherein the locking arm slides longitudinally along with the hinge-end slider.

8. The hair clip of claim 1, wherein the slider is a clasp-end slider and further includes a clasp extending therefrom and the locking arm includes a free end that is releasably locked by the clasp, wherein the locking arm does not slides longitudinally along with the clasp-end slider.

9. The hair clip of claim 1, wherein the guide track is provided by a channel that extends through the base and that receives at least a portion of the slider, the leaf spring has at least one end and the slider extends therefrom, and the slider includes a cap positioned at an outer surface of the base, wherein longitudinally moving the cap longitudinally slides the slider along the track to deflect the leaf spring between the more-bowed configuration and the less-bowed configuration.

10. A barrette for securing hair, comprising:

a longitudinal base;

a locking arm that pivots relative to the base between an open position and a closed position;

a leaf spring that has two ends, is positioned between the base and the locking arm, and cooperates with the locking arm to engage the hair to secure the barrette in the hair; and two adjustment couplings including two aligned guide channels formed longitudinally in the base and two sliders each received in a corresponding one of the channels, wherein the sliders extend from corresponding ones of the leaf spring ends, and the sliders each include an adjustment spring that extends therefrom and has an engagement portion, wherein the channels each define at least one serrated wall including teeth and notches, the notches defining locking stations, wherein the spring engagement portions seat in the notches and engage the teeth to releasably lock the spring engagement portions in place, and wherein the sliders are longitudinally slidable along the channels to deflect the leaf spring between a more-bowed configuration and a less-bowed configuration, in the more-bowed configuration the leaf spring exerting more compression against the locking arm and hair than it does in the less-bowed configuration.

11. The hair barrette of claim 10, wherein the spring engagement portion extends laterally from each of the sliders.

12. The hair barrette of claim 10, wherein the spring engagement portion extends upwardly from each of the sliders.

13. The hair barrette of claim 10, wherein each of the sliders includes a body that houses the adjustment spring and a window formed therein, and wherein the spring engagement portion resiliently deflects between an extended position extending through the window and into engagement with the serrated wall and a retracted position within the body.

14. The hair barrette of claim 10, wherein each of the channels defines two opposing serrated walls.

15. The hair barrette of claim 10, wherein the base includes a rail protruding therefrom, each of the channels is formed in the rail, and the spring engagement portion extends from each of the sliders and into a respective one of the channels.

16. The hair barrette of claim 10, wherein one of the sliders is a hinge-end slider and further includes a hinge bracket extending therefrom and the locking arm includes a hinged end connected to the hinge bracket, wherein the locking arm slides longitudinally along with the hinge-end slider.

17. The hair barrette of claim 10, wherein one of the sliders is a clasp-end slider and further includes a clasp extending therefrom and the locking arm includes a free end that is releasably locked by the clasp, wherein the locking arm does not slide longitudinally along with the clasp-end slider.

18. A clip for securing hair, comprising:

a longitudinal base;

a locking arm that pivots relative to the base between an open position and a closed position;

a leaf spring that is positioned between the base and the locking arm, wherein the locking arm and the leaf spring cooperatively engage the hair to secure the clip in the hair; and an adjustment coupling including at least one guide track formed by the base and at least one slider extending from the leaf spring, wherein the slider is longitudinally slidable along the track to deflect the leaf spring between a more-bowed configuration and a less-bowed configuration, in the more-bowed configuration the leaf spring exerting more compression against the locking arm and hair than it does in the less-bowed configuration, wherein the slider is a hinge-end slider and further includes a hinge bracket extending therefrom and the locking arm includes a hinged end connected to the hinge bracket, wherein the locking arm slides longitudinally along with the hinge-end slider.

19. A clip for securing hair, comprising:

a longitudinal base;

a locking arm that pivots relative to the base between an open position and a closed position;

a leaf spring that is positioned between the base and the locking arm, wherein the locking arm and the leaf spring cooperatively engage the hair to secure the clip in the hair; and an adjustment coupling including at least one guide track formed by the base and at least one slider extending from the leaf spring, wherein the slider is longitudinally slidable along the track to deflect the leaf spring between a more-bowed configuration and a less-bowed configuration, in the more-bowed configuration the leaf spring exerting more compression against the locking arm and hair than it does in the less-bowed configuration, wherein the slider is a clasp-end slider and further includes a clasp extending therefrom and the locking arm includes a free end that is releasably locked by the clasp, wherein the locking arm does not slide longitudinally along with the clasp-end slider.

* * * * *